United States Patent [19]

Chong

[11] Patent Number: 4,759,340

[45] Date of Patent: Jul. 26, 1988

[54] FIRE GRATE

[76] Inventor: Wun C. Chong, 63 Wallace Place, Delta, British Columbia, Canada, V4M 3S2

[21] Appl. No.: 58,420

[22] Filed: Jun. 5, 1987

[51] Int. Cl.[4] ..... F23H 13/00

[52] U.S. Cl. ..... 126/164; 126/152 B; 126/163 R

[58] Field of Search ..... 126/163 R, 163 A, 152 R, 126/152 A, 152 B, 164, 83, 165, 130, 298, 141, 143, 126, 120, 121; 237/51, 55

[56] References Cited

U.S. PATENT DOCUMENTS

| | | | |
|---|---|---|---|
| 4,261,323 | 4/1981 | Horwinski | 126/165 |
| 4,519,378 | 5/1985 | Mims | 126/165 |
| 4,557,250 | 12/1985 | Kramert | 126/120 |

*Primary Examiner*—James C. Yeung

*Attorney, Agent, or Firm*—Townsend & Townsend

[57] ABSTRACT

A fire grate having a support framework including an imperforate base plate, a rear backing plate and end plates. The grate has combustible material positioning and sensing means and can trap and reburn volatile products. Air delivery passages supply fresh air directly to the top of the grate to assist in reburning volatile products.

6 Claims, 1 Drawing Sheet

FIRE GRATE

FIELD OF THE INVENTION

This invention relates to a fire grate apparatus for holding and burning appropriate combustible material.

DESCRIPTION OF THE PRIOR ART

For some years now, artificial slow burning logs composed of waxes and petroleum by-products have been a popular method for enjoying an easily lit and long lasting fire in the home or cottage fireplace. These artificial logs manufactured by such companies as Shell or Exxon are generally rectangular and have an advertised burn life of approximately three hours. However, even with this extended burn life, a great deal of the slow burning log is not combusted, but simply volatilized by the heat of the fire to escape up the exhaust flue in a very wasteful process.

SUMMARY OF THE INVENTION

The present invention addresses this problem of inefficient use of available combustible material by providing a fire grate which traps volatilized products and reburns them in order to allow the slow burning log to burn for an extended period. Accordingly, the present invention is a fire grate comprising:

- a support framework including a inperforate base plate, a rear backing plate and end plates;
- combustible material positioning and sensing means;
- means to trap and reburn volatile products; and
- air delivery means to supply fresh air directly to said means to trap and reburn volatile products.

DESCRIPTION OF A PREFERRED EMBODIMENT

Figure 1:
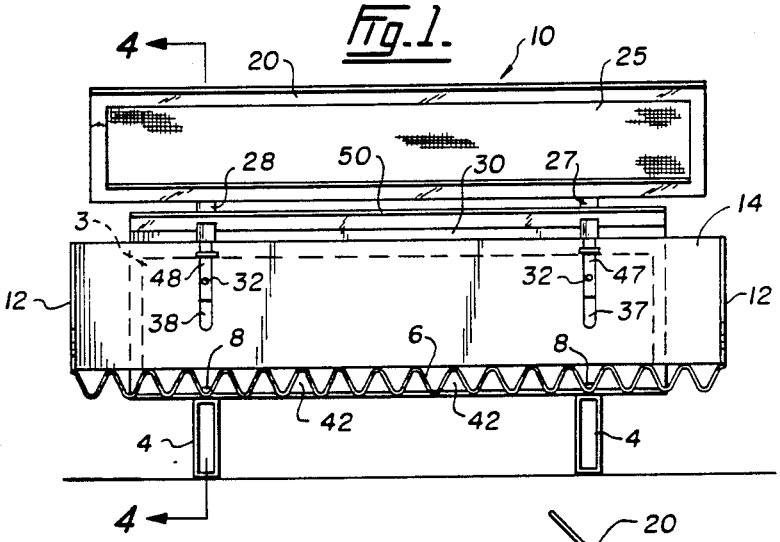
FIG. 1 is a front elevation of the present invention.

Referring to FIG. 1, the fire grate is generally designated by the numeral 10. Imperforate base plate 6 is supported by two pairs of U-shaped cast legs 4. Fasteners 8 extend through base plate 6 and through an upper flange in legs 4 to rigidly connect these components together. Base plate 6 is a rectangular shape formed into a regular undulating surface by peaks and valleys running parallel to the shorter sides of the rectangular shape. L-shaped end plates 12 are attached at each of the shorter edges of base plate 6. Rear backing plate 14 spans the distance between end supports 12 along one of longer sides of base plate 6. The lower edge of rear backing plate 14 is shaped to match the undulating surface of base plate 6 so that rear backing plate 14 and base plate 6 interlock together. End plates 12, rear backing plate 14 and base plate 6 which can be cast as a single stucture in a conventional manner form the support framework of the fire grate.

Figure 2:
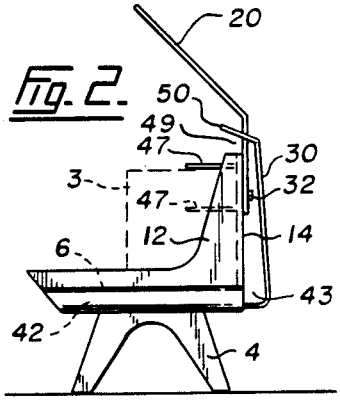
FIG. 2 is a side view of the present invention.
Figure 3:
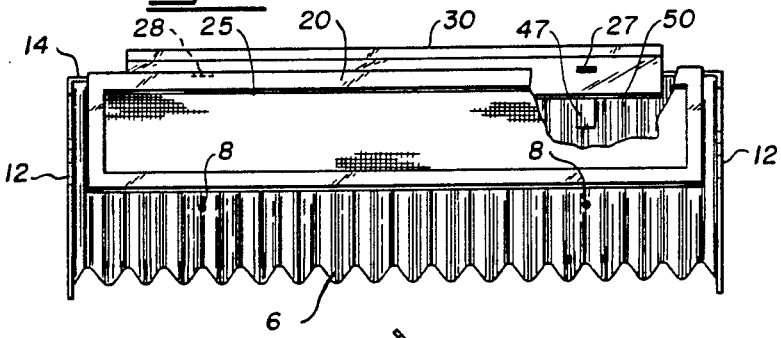
FIG. 3 is a plan view of the present invention.

Mounted above the support framework is frame member 20 which supports fine wire mesh 25. Frame member 20 is supported by arms 27 and 28 which are attached at points along the lower edge of frame member 20. Frame member 20 is attached to arms 27 and 28 at an angle as shown in FIG. 2, so that frame member 20 with fine mesh screen 25 overhangs base plate 6.

Figure 4:
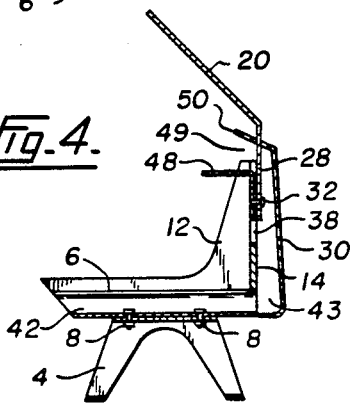
FIG. 4 is a section view taken along line 4-4 of FIG. 1.

Arms 27 and 28 extend downwardly behind backing plate 14 through access slots in covering plate 30 whose function will be described later. The lower portion of arms 27 and 28 line up with slots 37 and 38 cut into rear backing plate 14. Fasteners 32 attached to arms 27 and 28 extend through slots 37 and 38 to engage inverted L-shaped members 47 and 48 located in slots on the front side of backing plate 14 as best shown in FIG. 4. L-shaped members 47 and 48 comprise a first portion adjacent to backing plate 14 to which fastener 32 is attached, and a second upper portion extending outwardly from backing plate 14 over base plate 6. This second upper portion rests atop any combustible material 3 (shown by dotted lines in FIGS. 1 and 2) which is placed onto base plate 6, and serves to hold the combustible material on the base plate, as well as sensing the location or vertical level of this material. As combustible material 3 is consumed by flames and shrinks in size, L-shaped members 47 and 48 move downwardly. Fasteners 32 which extend through slots 37 and 38 transmit this downward movement to arms 27 and 28. As a result, frame member 20 with wire screen 25 moves downwardly maintaining a constant distance between the upper surface of combustible material 3 and wire mesh 25.

On the underside of base plate 6, a plurality of essentially rectangular passageways 42 are formed by sealing the lower edge of undulations in base plate 6. These passageways 42 extend underneath base plate 6, and communicate with the lower portion of cavity 43 formed between backing plate 14 and cover plate 30 which is mounted to the rear of backing plate 14. Cover plate 30 encloses cavity 43 along all edges except for upper opening 49 which extends along the top edge of backing plate 14. Opening 49, defined by the top edge of backing plate 14 and angled lip 50 of cover plate 30, directs air flowing from cavity 43 onto mesh screen 25.

When in use the present invention functions in the following manner:

Combustible material 3, ideally an artificial slow burning log, is placed on base plate 6 with the long's rear surface contacting backing plate 14, and with L-shaped members 47 and 48 resting atop the log's upper surface and resting in slots in the backing plate 14. Overhanging frame member 20 with mesh screen 25 is thus automatically positioned the necessary distance above combustible material 3 to perform its function of trapping and reburning volatile products.

Combustible material 3 is then lighted by conventional means and allowed to burn. During burning of artificial slow burning log, constituents of the log that are not combusted but volatilized by the heat of the fire will be trapped on mesh screen 25 as they drift upwardly. This trapping of the volatilized constituents is accomplished by physical filtering of the fire exhaust gases through fine wire mesh 25, and condensation of the constituents on the relatively cooler wire mesh. As these filtered and condensed constituents are trapped on fine mesh 25, they are reburned by the heat of the fire. This reburning process is assisted by fresh air being continuously supplied to mesh screen 25 along the lower edge of frame member 20 through opening 49. Air in cavity 43 heated by the fire rises naturally through opening 49, and replacement air enter cavity 43 through lower passageways 42 underneath base plate 6.

As the fire consumes the artificial log and it shrinks in size, L-shaped members 47 and 48 resting on the log's upper surface move downwardly in slots 37 and 38 causing frame member 20 and mesh screen 25 to move downwardly also, so that mesh screen 25 is always the optimal distance above combustible material 3 to perform its trapping and reburning function.

In testing a prototype model of the present invention, it was found that by trapping and reburing the volatilized constituents of an artificial slow burning log, the expected burn life can be increased by about 50% to 80%.

The grate provides support for the log on several sides and this acts to prevent the log breaking into smaller pieces. Smaller pieces burn more quickly. The inperforate base plate means that the ashes are kept in the grate, which makes disposal of the ashes easy and reduces cleaning of the fireplace. The solid surfaces at the back and base of the log reduce air supply and extend the burning time.

I claim:

1. A fire grate comprising:

a support framework including an imperforate base plate having a rear backing plate including slots and end plates to define an area for burning combustible material;

screen means to trap and reburn volatile products extending over said area for burning combustible material means for positioning said screen means and sensing a vertical level of said combustible material, said means for positioning and sensing being sliably mounted in said slots in said rear backing plate; and means to deliver fresh air to said means to trap and reburn volatile products.

2. A fire grate as in claim 1 in which said means for positioning and sensing combustible material comprises a pluality of L shaped members adapted for slidable movement in said slots in said rear backing plate, one leg of each L shaped member being rigidly attached to said screen means to trap and reburn volatile products and the other leg extending outwardly from said rear backing plate over said area for burning combustible material to rest atop the upper surface of said combustible material to securely position said combustible material atop said base plate whereby as said combustible material is consumed and shrinks in size, said L shaped members move downwardly in said slots ensuring that said wire mesh screen also moves downwardly and remains a constant distance above said combsutible material.

3. A fire grate as in claim 1 wherein said means to trap and reburn volatile products compries a fine meash screen.

4. A fire grate as in claim 1 wherein said base plate comprises an undulating surface with alternating peaks and valleys.

5. A fire grate as in claim 4 wherein said means to deliver fresh air to said means to trap and reburn volatile products comprises a plurality of passageways beneath said fire grate formed by said undulations in said base plate, said channels communicating with a cavity formed between said rear backing plate and a cover plate, said cavity haing an outlet adjacent said means to trap and reburn volatile products.

6. A fire grate as in claim 1 wherein said support framework is of case iron construction.

* * * * *